US008857359B1

(12) United States Patent
Gonzalez et al.

(10) Patent No.: US 8,857,359 B1
(45) Date of Patent: Oct. 14, 2014

(54) CLEAT SADDLE AND BOAT RAFTING SYSTEM

(71) Applicants: Ariel Gonzalez, Tampa, FL (US); Daniel Gonzalez, Tampa, FL (US)

(72) Inventors: Ariel Gonzalez, Tampa, FL (US); Daniel Gonzalez, Tampa, FL (US)

( * ) Notice: Subject to any disclaimer, the term of this patent is extended or adjusted under 35 U.S.C. 154(b) by 47 days.

(21) Appl. No.: 13/892,661

(22) Filed: May 13, 2013

Related U.S. Application Data

(60) Provisional application No. 61/647,740, filed on May 16, 2012.

(51) Int. Cl.
*E02B 3/24* (2006.01)
*B63B 21/00* (2006.01)

(52) U.S. Cl.
CPC ..... *B63B 21/00* (2013.01)
USPC ..... 114/230.15; 114/230.17

(58) Field of Classification Search
USPC ..... 114/230.15–230.17
See application file for complete search history.

(56) References Cited

U.S. PATENT DOCUMENTS

| | | | | | |
|---|---|---|---|---|---|
| 3,842,779 | A * | 10/1974 | Jaynes | 114/230.24 |
| 4,144,831 | A * | 3/1979 | Heydolph | 114/230.18 |
| 4,261,279 | A * | 4/1981 | Johnson | 114/220 |
| 4,751,892 | A | 6/1988 | Sechel et al. | |
| 4,817,551 | A * | 4/1989 | Matson | 114/230.15 |
| 5,230,295 | A * | 7/1993 | Shell | 114/218 |
| 5,327,845 | A * | 7/1994 | Cook | 114/218 |
| 5,519,959 | A * | 5/1996 | Cross | 43/21.2 |
| 5,987,707 | A * | 11/1999 | DeShon | 24/17 AP |
| 7,036,780 | B1 * | 5/2006 | Geninatti | 248/231.9 |
| 7,827,924 | B1 * | 11/2010 | Perez | 114/230.15 |
| 8,091,499 | B1 * | 1/2012 | Perez | 114/230.15 |
| 8,800,461 | B2 * | 8/2014 | Gagan, II | 114/230.17 |
| 2007/0193493 | A1 * | 8/2007 | Semler | 114/219 |

* cited by examiner

*Primary Examiner* — Lars A Olson
*Assistant Examiner* — Jovon Hayes
(74) *Attorney, Agent, or Firm* — Nilay J. Choksi; Smith & Hopen, P.A.

(57) ABSTRACT

A universal mounting interface for rope cleats on water vessels, docks, or other fixed structures. The current invention provides a cleat saddle from which spars or poles are extended and linked at a flexible but resilient arch connection to fend off the vessel from a dock or another vessel. The mounting interface may be seated in overlying relation to a boat cleat and held in place by any mounting means. The current invention further provides elbows connecting the mounting interface to the spars and acts as a juncture of resilience to external forces. Rotation channels in one or more of the components allow rotation and flexibility to resisting the external forces. Additionally, one or more of the components can have strength enhancing aspects to prevent bending or manipulation of the components in response to external forces. The goal is to provide a constant, though relatively flexible, distance between two objects.

20 Claims, 11 Drawing Sheets

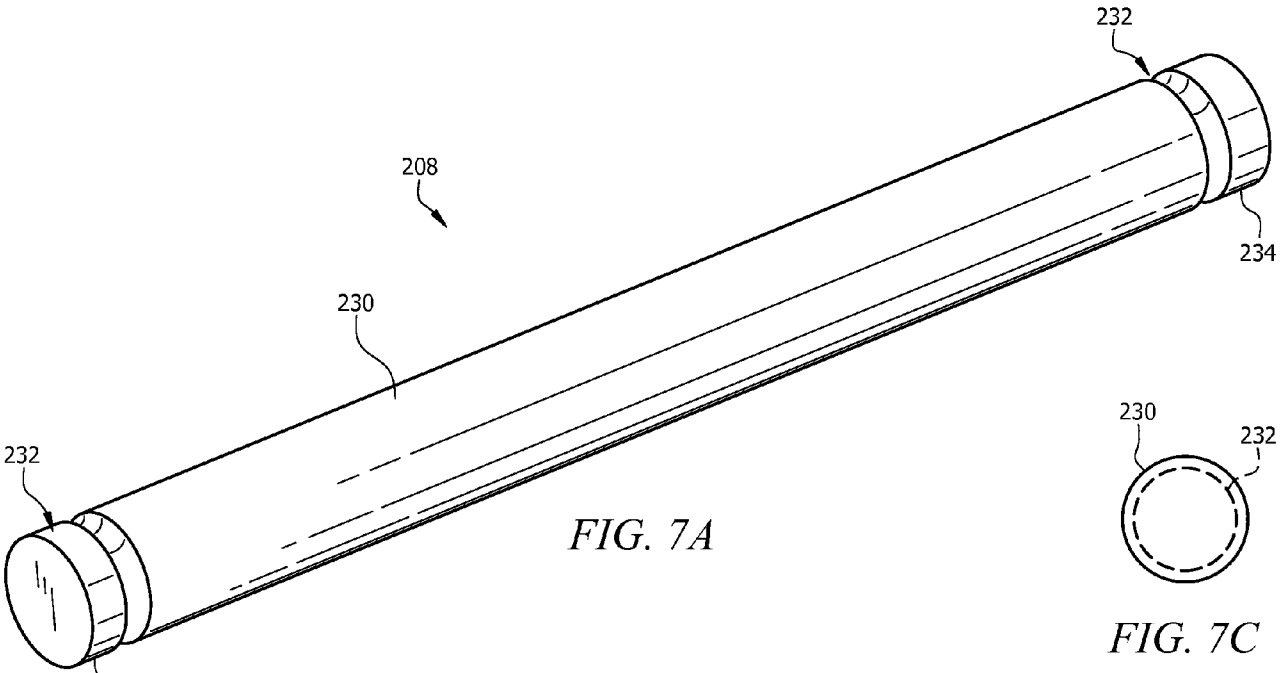
FIG. 7A
FIG. 7C
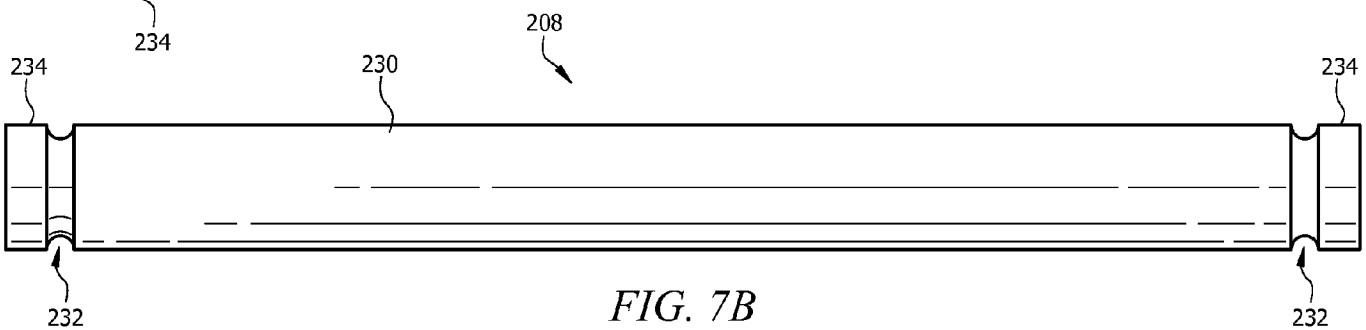
FIG. 7B

CLEAT SADDLE AND BOAT RAFTING SYSTEM

BACKGROUND OF THE INVENTION

1. Field of the Invention

This invention relates, generally, to mooring a boat to a fixed structure or another water vessel. More particularly, it relates to a universal cleat saddle adapted to fit spars or poles that moor a boat to a fixed structure or to another water vessel.

2. Description of the Prior Art

Attempts have been made to safely and securely moor a boat to a dock or to another boat. Most commonly, ropes are used to secure a boat to a dock, and bumpers are used to keep the dock from damaging the boat as the boat shifts about the water. However, this common methodology is not usually effective as the boat is not stabilized at a safe distance.

U.S. Pat. No. 4,261,279 to Johnson discloses a fender for a floating vessel to maintain separation between the vessel and a wharf to which the vessel is moored. The fender includes a thrust rod that extends from the vessel onto the wharf, the wharf end having elastic shock absorber elements and wheels to reduce friction between the thrust rod and the wharf. However, this fender has disadvantages including additional cost of having to install a more intricate shock absorber element on the wharf, movement of the fender on the wharf via the wheels, and rigidity of the thrust rod.

U.S. Pat. No. 5,519,959 to Cross discloses a mounting base for a fishing rod holder using a rope cleat to secure the mounting base beneath the rope cleat. However, this mounting base, though seemingly capable of holding a fishing rod in a single position, is wholly incapable of mooring a vessel to any fixed structure or to another vessel.

U.S. Patent Application Publication No. 2007/0193493 to Semler discloses a fender hardness assembly that includes a lanyard system that suspends a fender at its midsection. One end of the lanyard system is attached to a rope cleat of a boat, and the other end of the lanyard system is attached to a rope cleat of another boat or a dock. Thus, the fender is suspended between the two structures (boat/dock). This technology is incapable of maintaining separation between the two structures and is insufficient at preventing damage.

U.S. Pat. No. 4,751,892 to Sechel et al. discloses a marine standoff for maintaining a constant distance between the standoff and a vessel. One end of the standoff is an elastomer end attached to the dock, and the other end of the standoff is a snap clasp for attachment to a rope cleat. A cylindrical rod is disposed between the two ends. However, this standoff has disadvantages including additional cost of having to install the elastomer end of the standoff to the dock and rigidity of the rod.

U.S. Pat. No. 4,817,551 to Matson discloses a boat mooring device having a hollow tubular sleeve enclosing a stretchable cord with hooks at each end of the stretchable cord. Each hook would hook onto the rope cleat of a boat/dock to maintain a distance between the boats/dock as long as the length of the tubular sleeve. However, this mooring device has disadvantages of short life (e.g., cord wears down quickly), rigidity of the tubular sleeve, and inability to prevent motion parallel to the dock when the bow of the boat is not attached. This and all other referenced patents and applications are incorporated herein by reference in their entirety. Furthermore, where a definition or use of a term in a reference, which is incorporated by reference herein is inconsistent or contrary to the definition of that term provided herein, the definition of that term provided herein applies and the definition of that term in the reference does not apply.

Accordingly, what is needed is stable mooring of boats or other vessels to one another or to fixed structures, such as docks. However, in view of the art considered as a whole at the time the present invention was made, it was not obvious to those of ordinary skill how the art could be advanced.

While certain aspects of conventional technologies have been discussed to facilitate disclosure of the invention, Applicants in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

SUMMARY OF THE INVENTION

The long-standing but heretofore unfulfilled need for an improved, more effective and universal mounting interface for mooring a water vessel is now met by a new, useful and nonobvious invention.

In an embodiment, the current invention comprises a universal cleat saddle system for connecting a first object and a second object. The cleat saddle system includes a cleat saddle configured to engage and be secured to a rope cleat on the first object. The cleat saddle has a base, a means of securing the base to the rope cleat and an annular elbow attachment mechanism that extends from the base. The elbow attachment mechanism has a top edge and a rotation channel around the circumference of the attachment mechanism in proximity to the top edge. The system further includes a saddle elbow coupled to the cleat saddle and directed away from the first object. The saddle elbow has a means of securing the saddle elbow to the cleat saddle. The rotation channel on the cleat saddle allows the saddle elbow to rotate. The system further includes a lead spar coupled on its proximal end to the saddle elbow and a spar elbow coupled on its proximal end to the distal end of the lead spar. The spar elbow has a means of securing itself to the distal end of the first spar and is directed toward the second object. The spar elbow forms a juncture of resilience to external forces. The system further includes a second spar with a proximal end coupled to the distal end of the spar elbow. The spar elbow has a means of securing the spar elbow to the proximal end of the second spar. The system further includes an attachment apparatus that has connects the second spar to the second object, permanently or removably.

The attachment apparatus may be a trail saddle elbow coupled to the distal end of the second spar and direct toward the second object. The trail saddle elbow has a means of securing the trail saddle elbow to the distal end of the second spar. The attachment apparatus further includes a trail cleat saddle coupled to the trail saddle elbow. The trail cleat saddle is configured to engage and be secured to a trail rope cleat on the second object. The trail cleat saddle has a corresponding base and a means of securing the base to the trial rope cleat.

The cleat saddle system may further include a second rotation channel disposed about the circumference of the first spar close to one end of the first spar. The second rotation channel allows rotation of the first spar. The system may also include a third rotation channel disposed about the circumference of the second spar close to one end of the second spar. The third rotation channel allows rotation of the second spar. In further embodiments, the system may further include a divot on an opposite end of either or both of the first and second spars, where the opposite end is opposite from the rotation channels.

A pin channel may be disposed in tangential relation to the exterior of the saddle elbow in alignment with the rotation channel of the saddle cleat when the saddle cleat and saddle elbow are connected. The pin channel is structured to receive a pin that would secure the connection between the saddle cleat and the saddle elbow and allow rotation of the saddle elbow. When the pin is inserted through the pin channel, the pin sits in the rotation channel in the interior of the saddle elbow.

The means of securing the base to the rope cleat may be a strap channel positioned vertically along the base and structured to receive a strap for tightening the saddle cleat to the rope cleat.

A strength enhancer may be disposed contiguously with the base of the cleat saddle to prevent bending or manipulation of the cleat saddle in response to external forces.

A first and second strength enhancer may be disposed contiguously with the saddle and spar elbows, respectively, to prevent bending or manipulation of the saddle and spar elbows in response to external forces.

In a separate embodiment, the current invention includes a universal cleat saddle system for connecting a first and second object. The cleat sadly system includes a lead cleat saddle configured to engage a rope cleat on the first object, where the cleat saddle has a base and a means of securing the base to the lead rope cleat. A lead saddle elbow is coupled to the lead cleat saddle and directed away from the first object, where the lead saddle elbow has a means of securing the lead saddle elbow to the lead cleat saddle. A lead spar is coupled on its proximal end to the lead saddle elbow. A spar elbow has a lead portion coupled to the distal end of the lead spar and a trail portion coupled to the proximal end of a trail spar. The spar elbow is directed away from the first object (and toward the second object) and has a means of securing the spar elbow to the lead and trail spars. The lead and trail portions of the spar elbow are formed contiguously to form a juncture of resilience to external forces. A trail saddle elbow is coupled to the distal end of the second spar and is directed toward the second object. The trail saddle elbow has a means of securing the trail saddle elbow to the distal end of the trail spar. A trail cleat saddle is coupled to the trail saddle elbow and is configured to engage a trail rope cleat on the second object, where the rope cleat has a base and a means of securing the base to the rope cleat.

A first and second strength enhancer may be disposed contiguously with the lead and trail cleat saddles, respectively, to prevent bending or manipulation of the lead and trail cleat saddles in response to external forces.

A first, second, and third strength enhancer may be disposed contiguously with the lead saddle elbow, spar elbow, and trail saddle elbow, respectively, to prevent bending or manipulation of the saddle and spar elbows in response to external forces.

The lead and trail cleat saddles may each have an annular elbow attachment mechanism with a top edge and rotation channel disposed about the circumference of the mechanism near the top edge. The rotation channels allow for rotation of the lead and trail saddle elbows, respectively. In a further embodiment, a pin channel may be disposed in tangential relation to the exterior of the lead saddle elbow in alignment with the rotation channel of the lead saddle cleat when the lead saddle cleat and lead saddle elbow are connected. The pin channel is structured to receive a pin that would secure the connection between the lead saddle cleat and the lead saddle elbow and allow rotation of the lead saddle elbow. When the pin is inserted through the pin channel, the pin sits in the rotation channel in the interior of the saddle elbow.

The cleat saddle system may further include a first rotation channel disposed about the circumference of the lead spar close to one end of the lead spar. The first rotation channel allows rotation of the lead spar. The system may also include a second rotation channel disposed about the circumference of the trail spar close to one end of the trail spar. The second rotation channel allows rotation of the trail spar. In further embodiments, the system may further include a divot on an opposite end of either or both of the lead and trail spars, where the opposite end is opposite from the rotation channels.

The means of securing the base to the lead and trail rope cleats may each be a strap channel positioned vertically along the base and structured to receive a strap for tightening the lead and trail saddle cleats to the lead and trail rope cleats, respectively. The straps can be directed around or through the strap channels.

In a separate embodiment, the current invention includes a cleat saddle that engages a rope cleat that has opposing cleat horns. The cleat saddle includes a base, cleat teeth extending from the bottom of the base and structured to conform to the shape of the opposing cleat horns on top of the rope cleat. The cleat saddle further includes a means of securing the cleat saddle to the rope cleat. An annular attachment mechanism extends vertically from the top of the base of the cleat saddle. The attachment mechanism has a top edge and a rotation channels disposed about the circumference of the attachment mechanism close to the top edge. The attachment mechanism is structured to engage an extension apparatus, such as a spar system, in overlying relation to the top edge of the attachment mechanism.

The means of securing the cleat saddle to the rope cleat may be a strap channel positioned vertically along the base and structured to receive a strap for tightening the saddle cleat to the rope cleat. The strap can be directed around or through the strap channel.

A strength enhancer may be disposed contiguously with the base of the cleat saddle to prevent bending or manipulation of the cleat saddle in response to external forces.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the nature and objects of the invention, reference should be made to the following detailed disclosure, taken in connection with the accompanying drawings, in which:

FIG. 7A is an elevated perspective view of a spar as structured in the embodiment depicted in FIGS. 4A-4D.

FIG. 7B is a side view of the spar of FIG. 7A.

FIG. 7C is an end view of the spar of FIG. 7A.

DETAILED DESCRIPTION OF THE PREFERRED EMBODIMENT

In the following detailed description of the preferred embodiments, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

Certain embodiments of the current invention include a universal cleat saddle system that accommodates a stand-off spar for mooring a water vessel to a fixed structure (e.g., dock, floating dock, etc.) or another water vessel. The current invention is used to connect boats or other water vessels to a secondary structure. Structurally, the current invention is a universal mounting interface for boat cleats that provide a base from which spars or poles extend off the side of a boat, linked at an arch to fend off the water vessel from the secondary structure. The secondary structure may be a dock or other fixed structure or alternatively another water vessel. The arch or elbow to which the spar or pole is attached can be flexible but resilient to allow a varying degree of freedom or margin for movement.

Figure 1A:
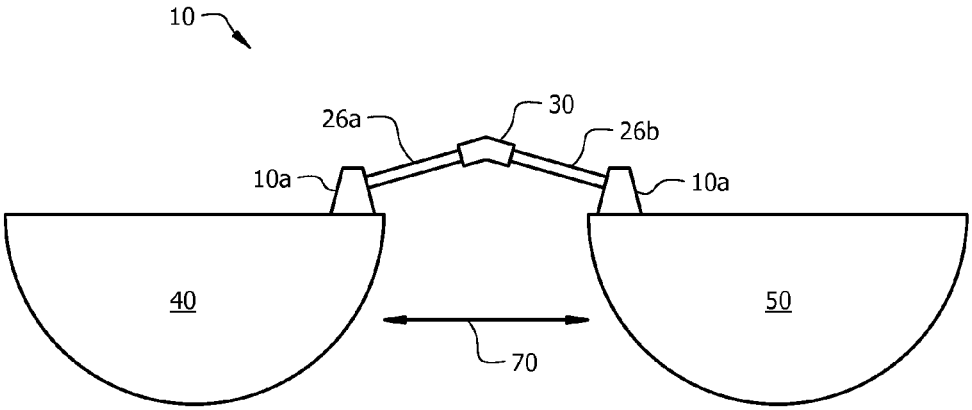
FIG. 1A depicts a water vessel connected to another water vessel using an embodiment of the current invention.
Figure 1B:
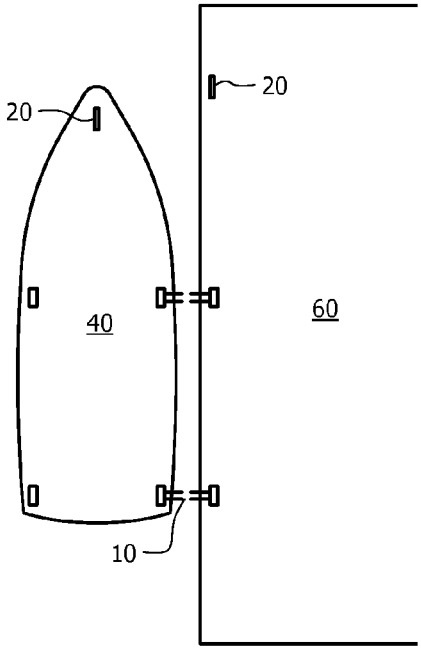
FIG. 1B depicts a water vessel connected to a dock or other fixed structure using an embodiment of the current invention.

As depicted in FIG. 1A, cleat saddle system, generally denoted by the reference numeral 10, is a boat rafting system that interconnects two water vessels 40, 50. In FIG. 1B, cleat saddle system 10 is a boat rafting system that interconnects water vessel 40 and dock 60. In these cases, cleat saddle system 10 is utilized to fully stabilize vessel 40 as it is moored to vessel 50 or dock 60.

Cleat saddle system 10 includes universal cleat saddles 10*a* disposed in overlying relation to rope cleat 20 on the periphery of water vessel 40 and water vessel 50 or dock 60. Cleat saddle 10*a* has any size and shape suitable for fitting over top or being disposed in overlying relation to conventional rope cleat 20. Cleat saddle 10*a* can be secured to rope cleat 20 by any suitable means, for example straps, VELCRO, snap clasps, hook clasps, etc.

As seen in FIG. 1A, cleat saddle 10*a* of water vessel 40 receives spar 26*a*. Cleat saddle 10*a* of water vessel 50 receives spar 26*b*. Spars 26*a*, 26*b* typically are formed of a substantially rigid material. Each spar 26*a*, 26*b* may be formed of the same material or different material, depending on the needs of the user. For example, spar 26*a* may be substantially rigid, while spar 26*b* may be formed of more flexible material. The needs may change based on I w Spars 26*a*, 26*b* are coupled to each other via bridle 30. Bridle 30 is angled and has an end opening at each end of bridle 30 to telescopically receive spars 26*a*, 26*b*. Bridle 30 may be formed of a substantially rigid or flexible material. If bridle 30 is made of a flexible material, water vessels 40, 50 would be given a higher degree of freedom to move toward and away from each other as spars 26*a*, 26*b* are drawn toward and away from each other. If bridle 30 is made of a highly flexible material, water vessels 40, 50 are given the freedom to move closer to each other and further away from each other. A highly rigid material would maintain a more consistent separation, indicated by reference numeral 70, between water vessels 40, 50.

Generally, the goal of cleat saddle system 10 is to maintain sufficient distance 70 between water vessels 40, 50 to securely and safely raft water vessels 40, 50. It is contemplated that cleat saddle system 10 can be used in substantially the same manner when mooring any water vessel to a fixed structure 60, such as a dock, as seen in FIG. 1B. It is also contemplated that bridle 30 is not present; rather spars 26*a*, 26*b* are formed of a single bent spar.

Cleat saddle 10*a* is disposed on each connected water vessel or fixed structure (e.g., dock). If two structures are connected, one or more cleat saddles 10*a* are disposed on each. Cleat saddles 10*a* may be substantially the same or different, as long as each of cleat saddle 10*a* is adapted to fit either or both of spars 26*a*, 26*b*.

The following examples are described herein to exemplify embodiments of the current invention, and should not be deemed limiting in scope of the current invention. Further, aspects of the following embodiments of the current invention are contemplated to be utilized individually or in combination within the scope of the current invention.

EXAMPLE 1

Figure 2:
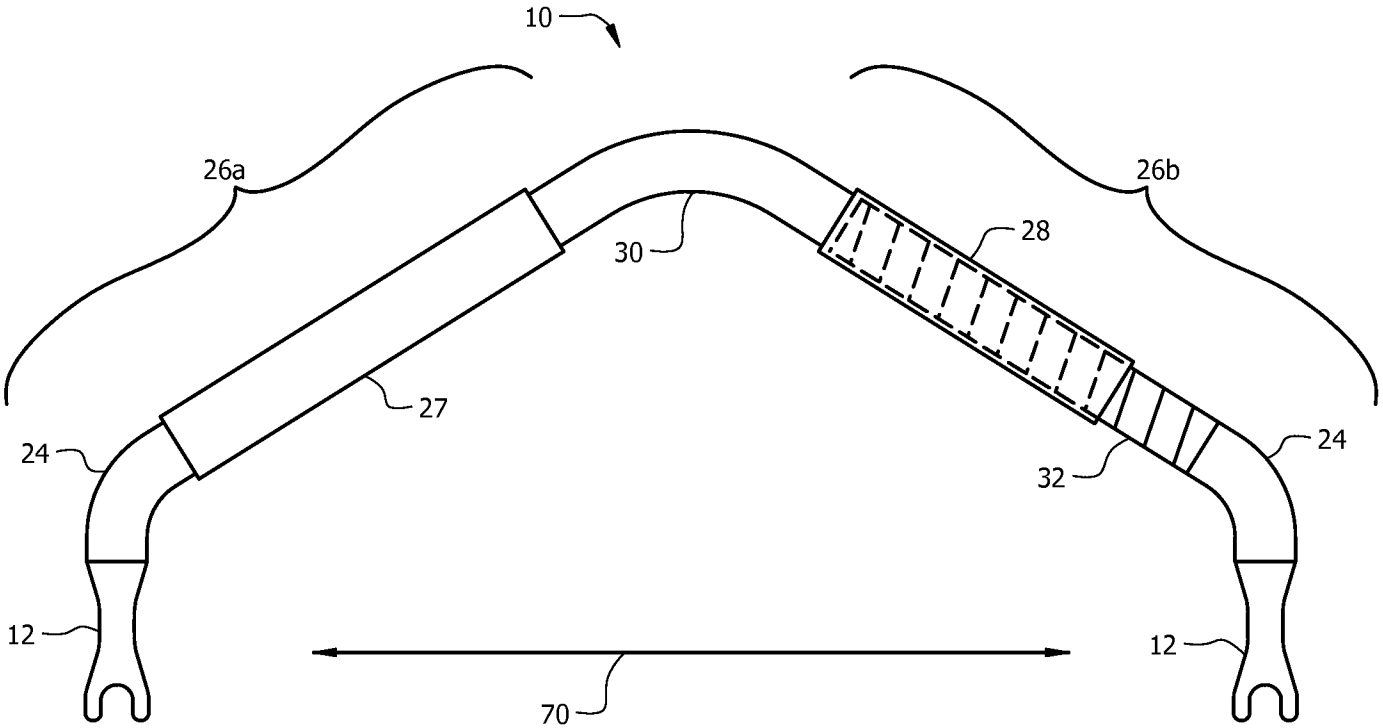
FIG. 2 is an elevated perspective view of an embodiment of the current invention.
Figure 3:
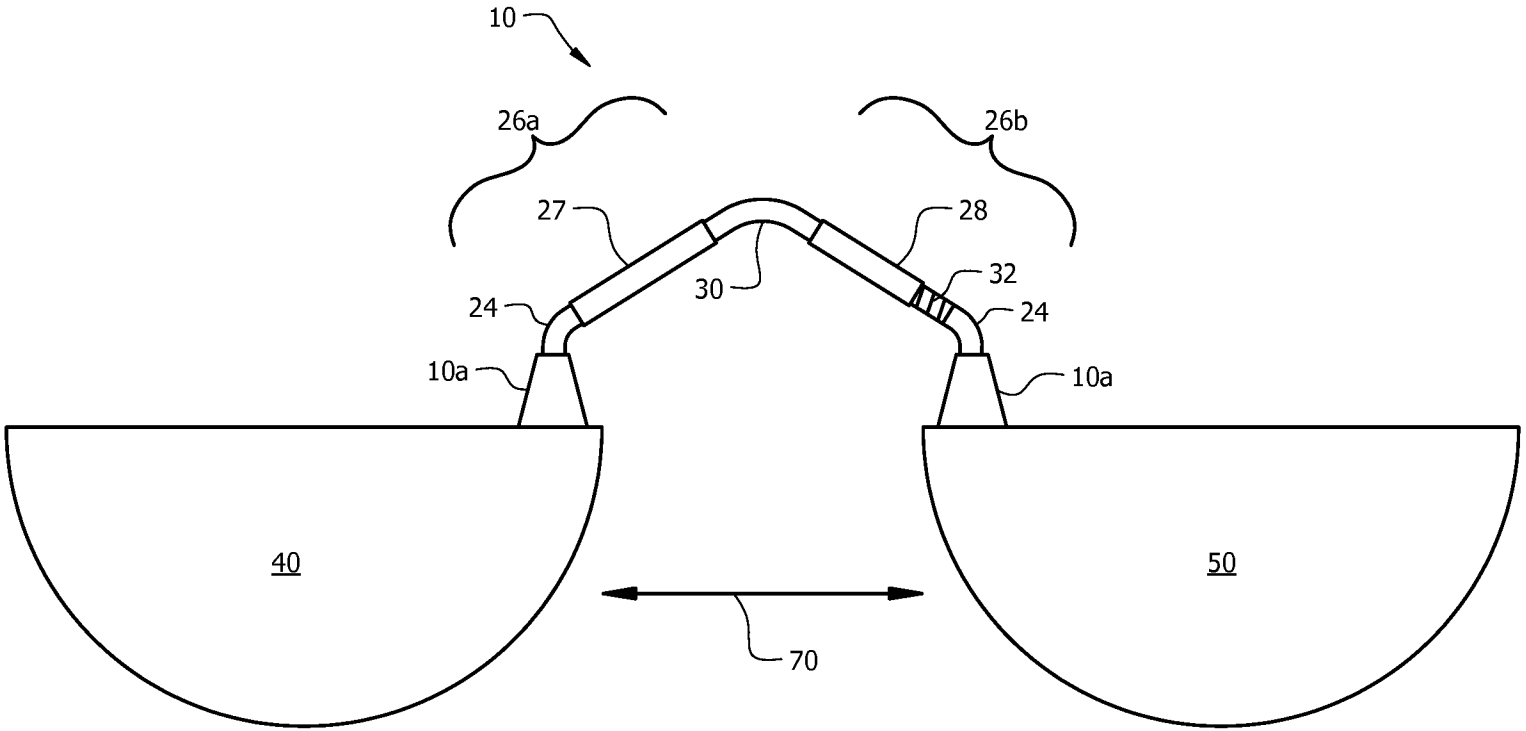
FIG. 3 depicts the embodiment of FIG. 2 in use, connecting a water vessel to another water vessel.

An embodiment of the current invention is illustrated in FIGS. 2 and 3. A spar system, generally denoted by the reference numeral 10, includes lead spar 26*a* and trail spar 26*b* connected via spar elbow 30. Lead spar 26*a* includes cleat saddle attachment 12, saddle elbow 24, and solid spar 27. Trail spar 26*b* includes threaded sleeve 28, solid screw insert 32, saddle elbow 24, and cleat saddle attachment 12.

Cleat saddle attachment 12 of lead spar 26*a* is mounted on a rope cleat, for example numeral 20 of lead vessel 40 as seen in FIGS. 1A and 1B. Saddle attachment 12 of trail spar 26*b* is mounted on another rope cleat to which the lead vessel wishes to be moored, for example numeral 20 of rafted vessel 50 or dock 60, as seen in FIGS. 1A and 1B. Lead spar 26*a* and trail spar 26*b* may be of the same length or differing lengths depending on the needs of the user.

Spar system 10 will be described herein from its attachment to lead vessel 40 to its attachment to rafted vessel 50 or dock 60. Saddle attachment 12 includes a bore for receiving elbow 24, and an attachment means for securing saddle attachment 12 to the rope cleat. This attachment means can be accomplished by snapping saddle attachment 12 around the rope cleat or tightening saddle attachment 12 to the top of the rope cleat via hooks, straps, clasps, magnets or other known attachment means.

From saddle attachment 12, saddle elbow 24 telescopically receives saddle attachment 12 or is telescopically received by saddle attachment 12. Saddle elbow 24 is angled away from saddle attachment 12 to which it is connected and toward rafted vessel 50 or dock 60.

Solid spar 27 telescopically receives elbow 24 or is telescopically received by elbow 24. Solid spar 27 is a thrust rod or stiff elongate rod that is substantially incapable of bending or manipulation. Solid spar 27 allows lead spar 26*a* to be rigid on the side of system 10 proximal to lead vessel 40. Spar 27 may be hollow to conserve materials for manufacture or may be solid for additional strength.

From solid spar 27, spar system 10*b* is angled toward rafted vessel 50 or dock 60 via spar elbow 30 leading into trail spar 26*b*. Spar elbow 30 is angled toward rafted vessel 50 or dock 60 and typically would be the apex of system 10.

Threaded sleeve 28 allows trail spar 26*b* to be more flexible than lead spar 26*a*, thereby providing spar system 10 with a degree of flexibility for movement of lead vessel 40 (and rafting vessel 50, if applicable).

Solid screw insert 32 provides rigidity to spar system 10 and is telescopically received within threaded sleeve 28, such that solid screw insert 32, saddle elbow 24, and saddle attachment 12 of trail spar 26*b* can be removable. Saddle attachment 10 of trail spar 26*b* is attached to saddle cleat 12 of rafting vessel 50 or dock 60.

Once saddle attachments 12 are secured to vessel 40 and vessel 50 or dock 60, a consistent separation 70 between the structures can be maintained (i.e., resilient to change in distance), but spar system 10 remains flexible enough to withstand or absorb any vessel's pitching and rolling caused by winds or waves.

EXAMPLE 2

Figure 4A:
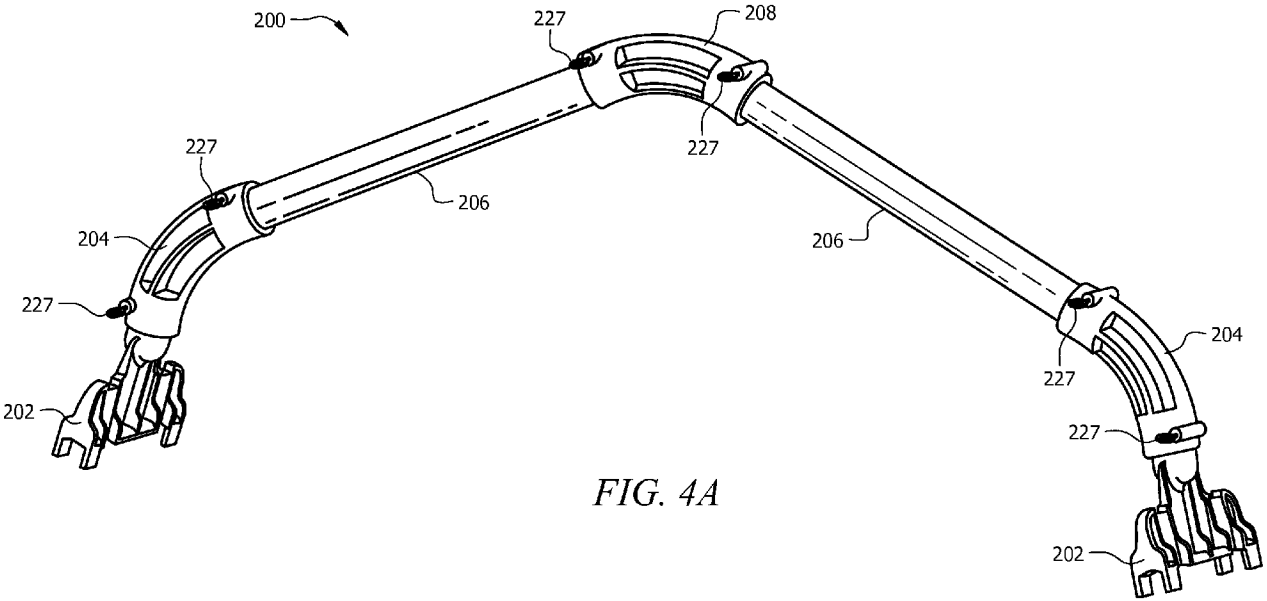
FIG. 4A is an elevated perspective view of an embodiment of the current invention when fully assembled.
Figure 4B:
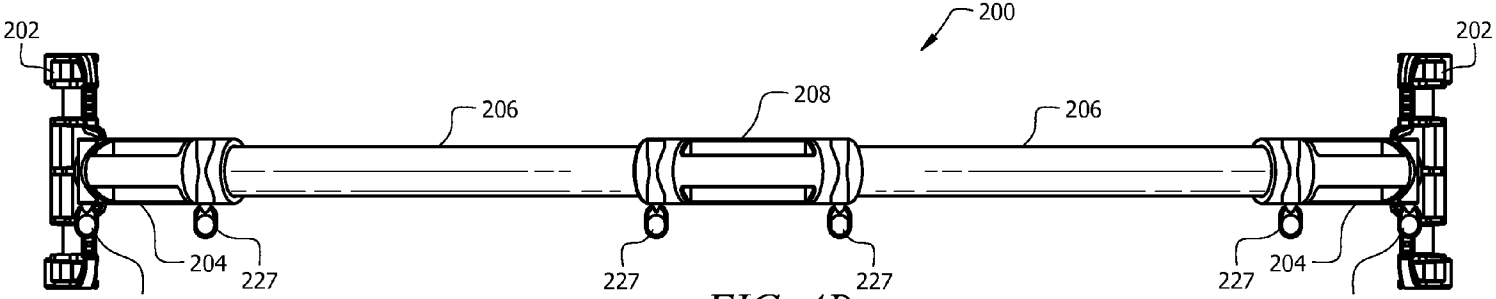
FIG. 4B is a top view of the embodiment of FIG. 4A.

FIGS. 4A-7B depicts an embodiment of the current invention and its components thereof. A spar system according this an embodiment of the current invention is denoted generally by the reference numeral 200. Spar system begins on one side with cleat saddle 202, to which is coupled the proximal end of saddle elbow 204. Saddle elbow 204 is angled, as seen in FIGS. 4A and 4C, away from saddle cleat 202. Saddle elbow 204 can be formed of any rigid or flexible material, wherein the rigidity is dependent on the desirability of freedom to bend, such that a more flexible material would allow system 200 to stretch or contract, thereby effecting the amount of distance between the vessels or objects attached to one another.

Whereas the proximal end of saddle elbow 204 is coupled to cleat saddle 202, the distal end of saddle elbow 204 is coupled to the proximal end of spar 206. Typically, spar 206 is formed of a rigid material to provide stability to system 200 holding the vessels or objects at a predetermined distance away from each other. However, this may put extra pressure on elbows 204, 208, so a softer or more flexible material for spars 206 is contemplated as well.

Figure 4C:
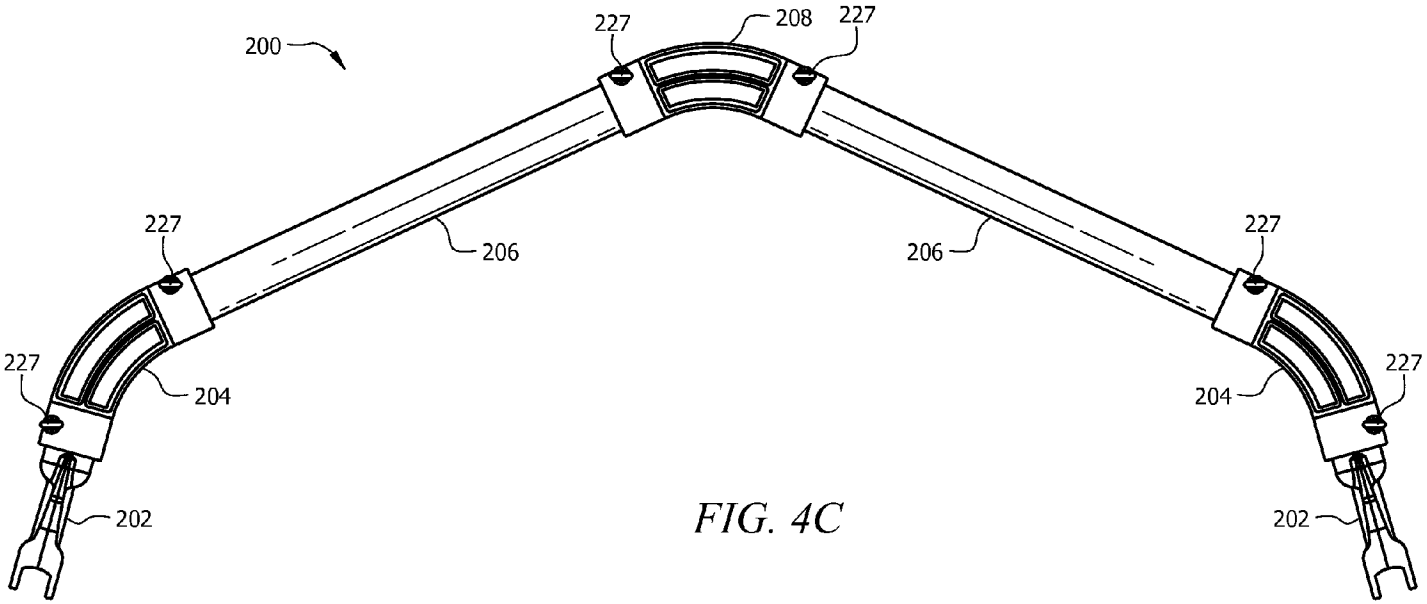
FIG. 4C is a side view of the embodiment of FIG. 4A.
Figure 4D:
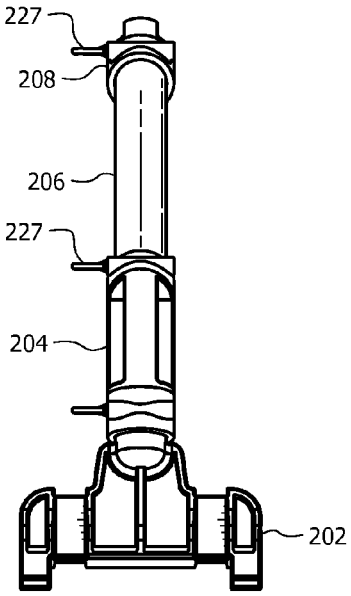
FIG. 4D is an end view of the embodiment of FIG. 4A.

Whereas the proximal end of spar 206 is secured—permanently or removably—to saddle elbow 204, the distal elbow of spar 206 is coupled and secured—permanently or removably—to spar elbow 208. As can be seen in FIGS. 4A and 4C, spar elbow 208 is angled toward vessel 50, dock 60, or other object to which vessel 40 is moored. Spar elbow 208 can be formed of any rigid or flexible material, wherein the rigidity is dependent on the desirability of freedom to bend, such that a more flexible material would allow system 200 to stretch or contract, thereby effecting the amount of distance between the vessels or objects attached to one another.

The distal end of spar elbow 208, which is directed toward trailing vessel 50, dock 60, or other object, is coupled to the proximal end of spar 206. Spars 206 on each side of system 200 are identical or substantially similar. Flexibility of the materials in each or size of each may differ based on needs of system 200.

The distal end of spar 206 is coupled to cleat saddle 202 on the distal end of spar system 200. Thus, in a typical embodiment, as particularly evident in FIG. 4C, two cleat saddles 202 are utilized in system 200 and are diametrically opposed to one another, as are saddle elbows 204 and spars 206. Cleat saddles 202, saddle elbows 204, and spars 206 may be respectively identical or substantially similar to one another for ease of manufacture or use. However, it is also contemplated that they can different from one another, respectively, depending on the needs of the user. For example, cleat saddle 202 on the distal end of system 200 may be permanently coupled to a rope cleat or dock, whereas cleat saddle 202 one the proximal end of system 200 would be removable from the rope cleat.

The coupling of components (e.g., cleat saddle 202, saddle elbows 204, spars 206, and spar elbow 208) can be accomplished via any known means. For example, each connection can be permanent or removable. The connections themselves can be, for example, telescopic fitting, various types of clasps, glue or welding, straps, or other means. The means of coupling these components together must be suitable to withstand pitching and rolling caused by winds or waves, or other forces.

Optionally, a threaded screw (not shown in these figures) can be disposed between spar 206 and saddle elbow 204 on the distal end of system 200. This threaded screw would be similar to that seen in FIGS. 2 and 3 and would be used in embodiments where the distal components are detachable and where a boat would be moored to a dock or other fixed structure.

Figure 5A:
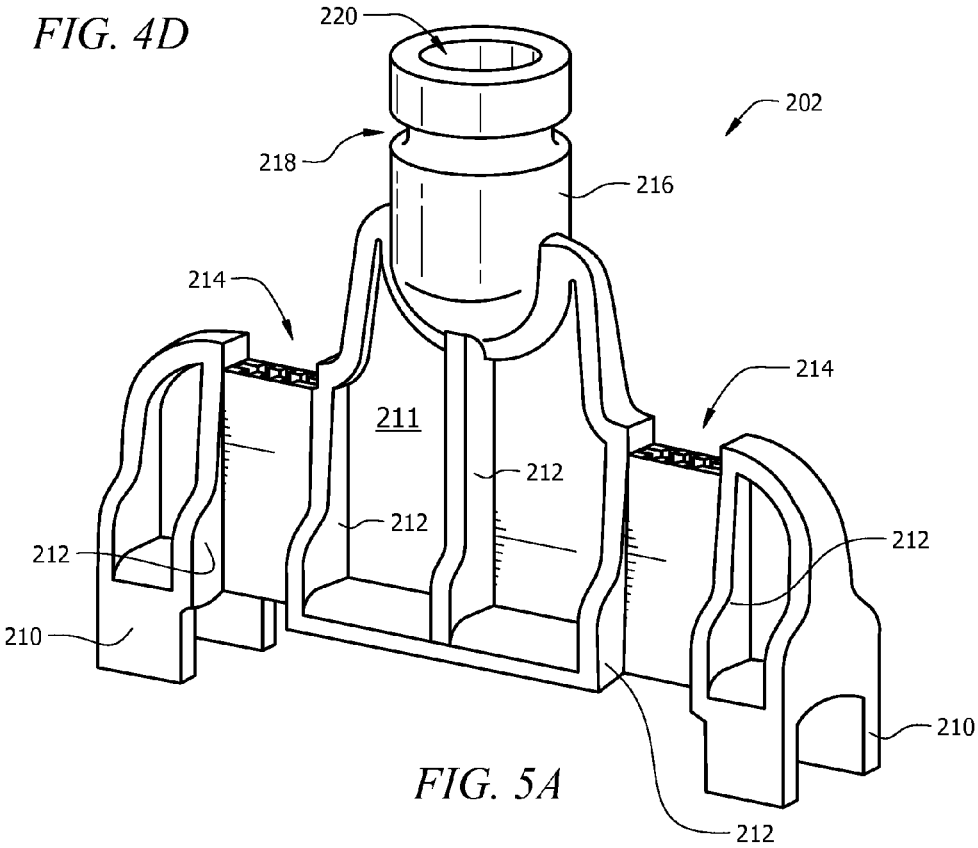
FIG. 5A is an elevated perspective view of a saddle cleat as structured in the embodiment depicted in FIGS. 4A-4D.
Figure 5B:
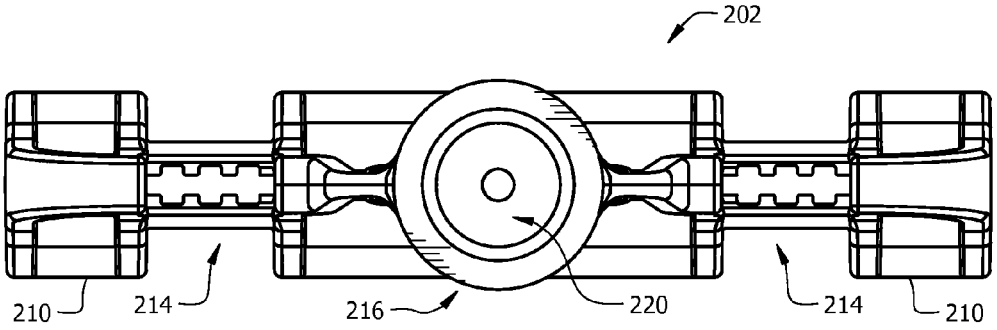
FIG. 5B is a top view of the saddle cleat of FIG. 5A.
Figure 5C:
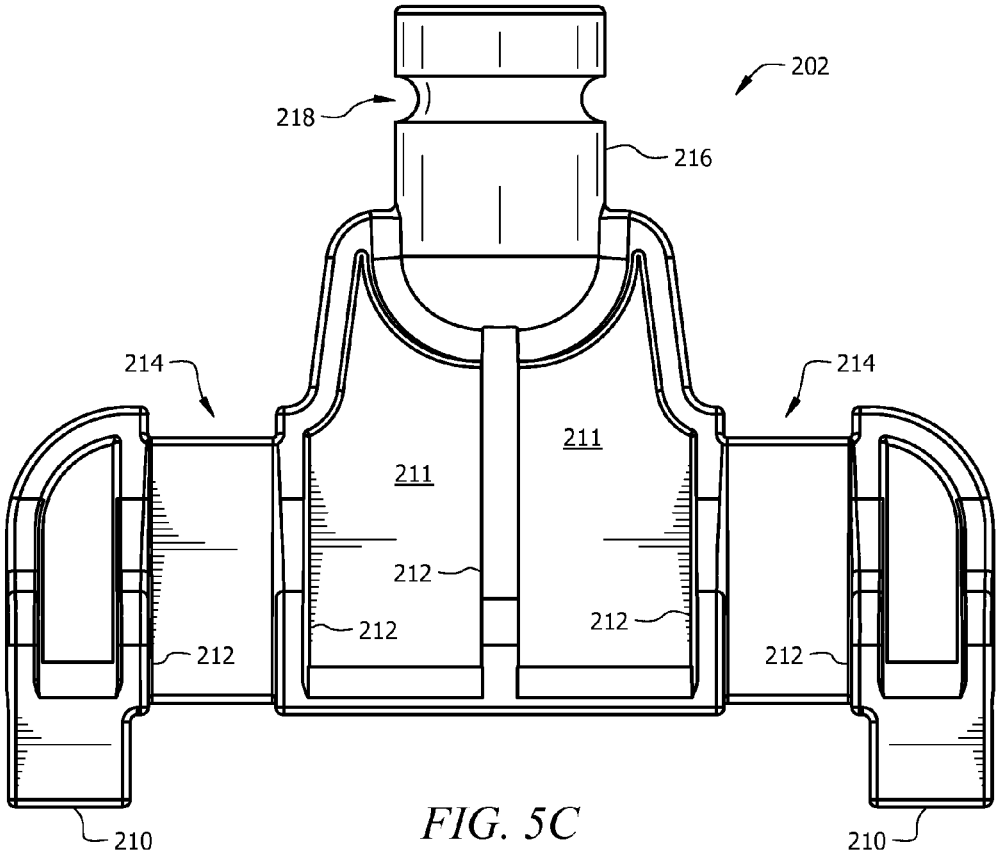
FIG. 5C is a side view of the saddle cleat of FIG. 5A.
Figure 5D:
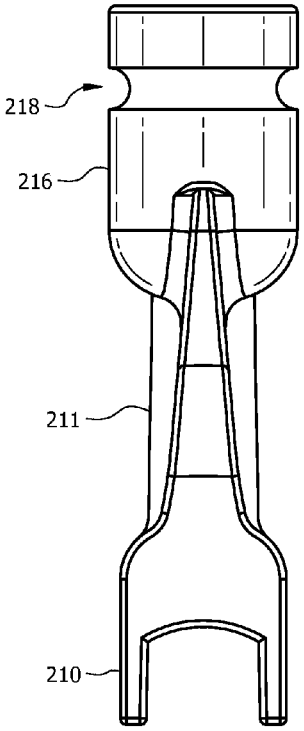
FIG. 5D is an end view of the embodiment of FIG. 5A.

FIGS. 5A-5D provide more detailed views of cleat saddle 202. Cleat saddle 202 includes base 211 and saddle teeth 210 on each side of cleat saddle 202 to correspond to each end of a standard rope cleat. Saddle teeth 210 can be shaped to conform to the configuration of the rope cleat, as can be seen in FIG. 5D with an arch along their top surface to conform to the shape of the corresponding rope cleat.

Saddle teeth 210 may be structured to sit on top of the rope cleat or itself be secured to the rope cleat by snapping around the rope cleat or other known means of firm securement to the rope cleat.

Alternatively, another means of securing cleat saddle 202 to the rope cleat can be used in lieu of or in addition to saddle teeth 210. For example, as seen in FIGS. 5A-5C, cleat saddle 202 can include strap channels 214 that are structured to direct a strap around the top of channel 214, through the interior of channel 214 (FIG. 5B), and down each side of base 211. The strap (not shown) would then be directed underneath the rope cleat and tightened to firmly secure cleat saddle 202 on top of the rope cleat. One or more strap channels 213 can be disposed along base 211. In the current described embodiment, two strap channels 214 are disposed on each side of the center of base 211.

Additionally, one or more means 212 of strengthening the integrity of cleat saddle 202, in particular base 211 of cleat saddle 202, can be disposed on cleat saddle 202. As seen in FIGS. 5A and 5C, strengthening means 212 is a plurality of flanges extending perpendicular to the face of base 211. In this case, flanges 212 prohibit base 211 from bending, twisting, or contorting in an undesirable way, particularly when cleat saddle 202 is disposed in overlying relation to the rope cleat and is in use. Flanges 212 enhance the rigidity of base 211. Although flanges 212 are described herein, other means of strengthening, or strength enhancers, are contemplated by the current invention. Base 211 is seen thinner than flanges 212 (FIG. 5B) and can be structured in this way to reduce cost of materials and manufacture.

Annular elbow attachment 216 is disposed in overlying relation to base 211 on saddle cleat 202, as evident in FIGS. 5A and 5B. Elbow attachment 216 may be substantially hollow and may include bore 220 at its top edge, if necessary for attachment to saddle elbow 204 or if necessary to conserve materials for manufacture. Elbow attachment 216 further includes rotation channel 218 disposed around the circumference of elbow attachment 216 and proximal to the top edge of elbow attachment 216, as clearly seen in FIGS. 5C and 5D. When saddle cleat 202 and saddle elbow 204 are coupled to one another, for example by saddle elbow 204 telescopically receiving saddle cleat 202 as in FIG. 4A, rotation channel 218 allows saddle elbow 204 to rotate or swivel about its center axis. The ability for saddle elbow 204 to rotate provides flexibility for the attached boat/vessel to pitch or roll without putting too much pressure on each component of system 200. This minimizes chances of system 200 fracturing or breaking on account of winds, waves, or other forces.

FIGS. 6A-6D depict saddle elbow 204 and spar elbow 208 in more detail. It is contemplated by the current invention that saddle elbow 204 is identical or substantially similar to spar elbow 208 for ease of manufacture and ease of use, since elbows 204,208 would be interchangeable. Elbows 204,208 normalize or distribute the manipulating and twisting force experienced by elbows 204,208 across all components in system 200 to each boat 40,50 and/or dock 60, or other structure.

Elbow 204,208 is angled and includes body 222 with bores 228 and each end of elbow 204,208. Thus, each end of elbow 204,208 is substantially hollow to telescopically receive cleat saddle 202 and spar 206 on each respective end.

Figure 6A:
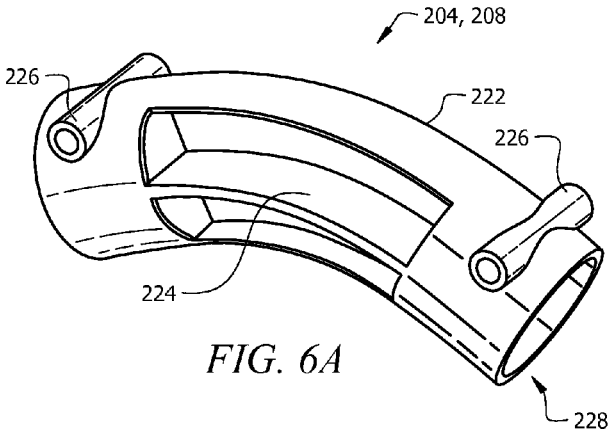
FIG. 6A is an elevated perspective view of a saddle elbow and/or a spar elbow as structured in the embodiment depicted in FIGS. 4A-4D.

Between the two ends of body 222 of elbow 204,208, one or more means 224 of strengthening the integrity of elbow 204,208, in particular body 222 of elbow 204,208, can be disposed on elbow 204,208. As seen in FIG. 6A, strengthening means 224 is a flange extending perpendicular to the face of body 222. In this case, flange 224 on each side of body 222 prohibits body 222 from bending, twisting, or contorting in an undesirable way, particularly when system 200 and elbow 204,208 are in use. Flange 224 enhances the rigidity of body 222. Although flange 224 is described herein, other means of strengthening, or strength enhancers, are contemplated by the current invention.

Figure 6B:
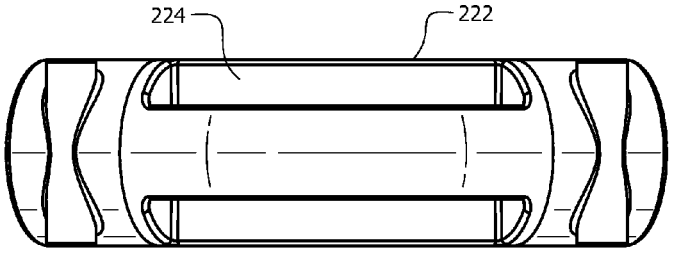
FIG. 6B is a top view of the saddle/spar elbow of FIG. 6A.

Further, body 222 can be seen in FIG. 6B to be thinner than flanges 224 and can be structured in this way to reduce the cost of materials and manufacture.

Figure 6C:
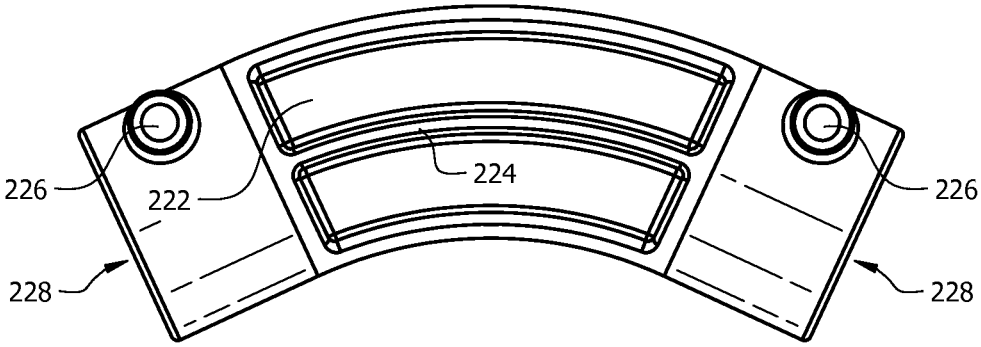
FIG. 6C is a side view of the saddle/spar elbow of FIG. 6A.
Figure 6D:
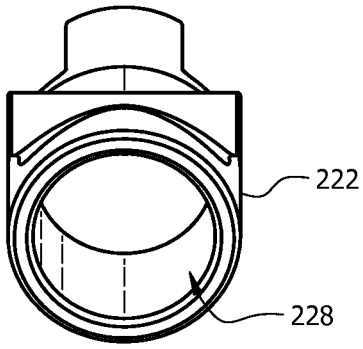
FIG. 6D is an end view of the saddle/spar elbow of FIG. 6A.

Additionally, as seen in FIGS. 6A and 6C, elbow 204,208 can include elongate pin channel 226 disposed proximal to each end of elbow 204,208 in perpendicular relation to the longitudinal extent of body 222. Pin channel 226 is adapted to receive pin 227 that further secures cleat saddle 202 and spar 206 to each respective end of elbow 204,208. Other means of further securing the components to elbow 204,208 are contemplated by the current invention as well, for example hooks, clasps, welding, snug fittings among the components, screws, pop-up pins, springs and bellows, locking mechanisms (e.g., barrel bolts), among other known means of fastening two objects together.

FIGS. 7A-7C depict spar 208 in further detail. It is contemplated by the current invention that spar 208 on the proximal side of system 200 is identical or substantially similar to spar 208 on the distal side of system 200 for ease of manufacture and ease of use, since spars 206 would be interchangeable. Spars 206 typically are rigid and allow elbows 204,208 experience the brunt of external force, though elbows 204, 208 distribute that force to spars 206 as well. However, it is contemplated that spars 206 can also be relatively flexible if desired by the user.

Spar 206 is substantially straight, though embodiments of the current invention contemplate curved spars to soften the external bending forces experienced by the spars. Optionally, spar 206 can be expandable or retractable by any conventional method, for example telescopically, such that the user can control distance between the water vessels and/or fixed structures.

Spar 206 includes body 230 with ends 234 that are telescopically received in the hollow ends of elbows 204,208, though other means of connecting the components are contemplated, as previously discussed. Body 230 of spar 206 may be hollow to conserve material for manufacture or may be solid to enhance strength. Any suitable material or combination of materials may be used to serve the stabilizing purpose of spar 206.

Spar 206 further includes rotation channel 232 disposed around the circumference of spar 206 and in proximity to at least one or both ends of spar 206, as can be seen in FIGS. 7A and 7B. When spars 208, saddle elbows 204, and spar elbow 208 are configured and connected to one another as seen in FIG. 4A (i.e., rotation channel 232 disposed at each end of spar 206), rotation channel 232 allows saddle elbow 204 and spar elbow 208 to rotate or swivel about their center axes. The ability for saddle elbow 204 and spar elbow 208 to rotate provides flexibility for the attached boat/vessel to pitch or roll without putting too much pressure on each component of system 200. This minimizes chances of system 200 fracturing or breaking on account of winds, waves, or other forces.

When elbow 204,208 is coupled to spar 206, pin 227 can be inserted through pin channel 226, where pin 227 would be disposed within rotation channel 232 and tangential to the circumference of rotation channel 232. An opening would be disposed in elbow 204,208 at the placement of pin channel 226 such that the interior of pin channel 226 would be in open communication with the interior of elbow 204,208. Thus, spar 206 or elbow 204,208 can rotate about each other while pin 227 has secured the connection between spar 206 and elbow 204,208. During the entirety of the rotation, pin 227 would be disposed through pin channel 226 and within rotation channel 232 of spar 206.

EXAMPLE 3

Alternatively, each or both of spars 206 can be replaced or used interchangeably with ridged spar 240, as depicted in FIGS. 8A-8D. Spar 240 includes body 242 that is ridged (FIGS. 8B-8D) for efficient manufacture (i.e., reduced materials) but enhanced strength, similar to strengthening means 212,224 of cleat saddle 202 and elbow 204,208, respectively.

Spar 240 further includes rotation channel 232 on one end, similar to that seen with spar 206. On the opposite end of spar 240, though, spar 240 includes stabilizing channel 244, where spar 206 included an additional rotation channel 232. Stabilizing channel 244 functions similar to the previously described in that pin 227 is inserted through pin channel 226 and disposed within channel 244. The difference is that because stabilizing channel 244 does not extend around the entire circumference of spar 240, spar 240 remains strong and stationary and cannot rotate (or freedom of rotation is minimized). Typically, this end of spar 240 with stabilizing channel 244 would be disposed within saddle elbows 204; the opposite end of spar 240 with rotation channel 244 would be disposed within spar elbow 208. This configuration allows each connection between saddle elbow 204 and spar 240 to remain stable with minimal or no rotation, though the two components together might be able to rotate because of rotation channel 218 in cleat saddle 202. However, a fixed connection (i.e., that connection where stabilizing channel 244 is disposed) provides some stability to system 200, rather than allowing everything to be rotatable.

Optionally, as seen in FIG. 5D, disc or ring 246 can be disposed at each end of spar 240 in order to provide enhanced strength to spar 240. Typically, ring 246 might be used if body 242 of spar 240 is manufactured as substantially hollow, for example to reduce materials needed in manufacture. Ring 246 can be made of any suitable material, such as aluminum metal, that would strengthen the overall integrity and sustainability of spar 240.

Definitions of Claim Terms

Annular elbow attachment mechanism: This term is used herein to refer to an aspect of a cleat saddle that is structured and adapted to be coupled to an elbow, such as a saddle elbow as used in the current invention.

Attachment apparatus: This term is used herein to refer to any structure that can secure a spar to an object, typically such as a dock or other fixed structure, either permanently or removably.

Cleat saddle: This term is used herein to refer to a mounting interface that can be used across a wide range of rope cleats, typically seen on water vessels or docks. From the mounting interface, any number of devices can be attached, for example a series of elbows and spars for maintaining a distance between two water vessels, a water vessel and a dock, etc.

Distal: This term is used herein to refer to the spatial distance of an aspect of a component to a lead object or "first" object as the case may be. A distal aspect of a component is further from the lead object than the proximal aspect.

Figure 8A:
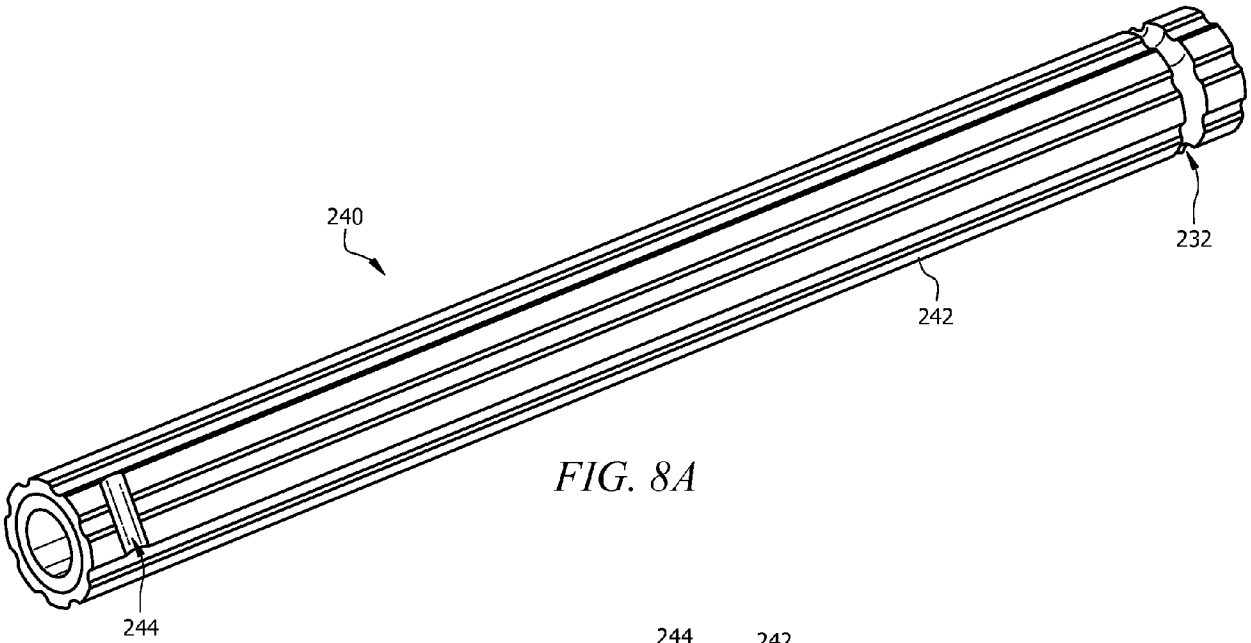
FIG. 8A is an elevated perspective view of a spar as structured and may be used in an alternate embodiment of the current invention.
Figure 8D:
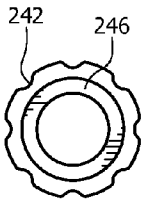
FIG. 8D is an end view of the spar of FIG. 8A.
Figure 8C:
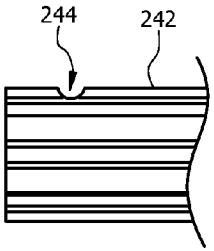
FIG. 8C is a side end view of the spar of FIG. 8A.
Figure 8B:
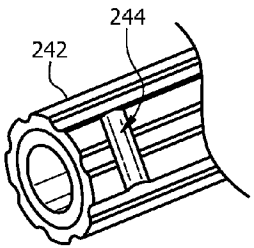
FIG. 8B is an elevated perspective end view of the spar of FIG. 8A.

Divot: This term is used herein to refer to an elongate indentation or trench within a component, as seen in FIGS. 8A-8C by the reference numeral 244. Thus, when the end of a component (e.g., spar) containing this divot is inserted into an elbow, the divot can line up with the pin channel, so when the pin is inserted, the pin lies in the divot, preventing rotation of that end of the component.

Juncture of resilience: This term is used herein to refer to an apical point of a spar elbow that maintains the spars in their general position, while retaining the flexibility to withstand external forces.

Lead: This term is used herein to refer to a reference point as the claimed invention is described, such that the current invention is described from the "lead" object or components to the "trail" object or components. The "lead" object and components are initially described and are on the left half of the system—when seen in FIG. 4C, for example—until the apical point of the spar elbow.

Means of securing: This term is used herein to refer to any structure that is capable of fastening to structures together.

Object: This term is used herein to refer to any structure desired to maintain a relatively constant distance from another structure. Examples include, but are not limited to, a water vessel, a dock, a water skier behind a boat, among others.

Pin channel: This term is used herein to refer to a passageway through which a pin can be inserted to secure two components of the current invention to one another. Typically, a pin channel lies tangential to the outside of an elbow, so when a spar or cleat saddle is inserted into the elbow, the rotation channel or divot of that spar or cleat saddle is aligned with the pin channel. Thus, when a pin is inserted through the pin channel, the pin also lies in that rotation channel or divot.

Proximal: This term is used herein to refer to the spatial proximity of an aspect of a component to a lead object or "first" object as the case may be. A proximal aspect of a component is closer to the lead object than the distal aspect.

Proximity: This term is used herein to refer to the spatial relationship of two structures or aspects of a single structure being close to one another. For example, as seen in FIGS. 5A and 5C, the current invention contemplates that rotation channel 218 is in "proximity" to the top edge of annular elbow attachment 216.

Rotation channel: This term is used herein to refer to a passageway used to facilitate the rotation of a connected component in the current invention. For example, a rotation channel on a cleat saddle facilitates rotation of the connected saddle elbow. The rotation permits flexibility for a component to alleviate pressures from external forces experienced by that component.

Saddle elbow: This term is used herein to refer to a structural fitting that typically turns a corner from the object to the spar. Essentially, the saddle elbow connects the saddle cleat and the spar. The angle of the saddle elbow typically is any obtuse angle, though smaller angles are contemplated as well. Additionally, the current invention contemplates pivoting of this angle, such that as distance becomes greater between the two objects, the angle becomes larger, and vice versa. The measure of angle may be motorized as well to maintain control of the angle.

Spar elbow: This term is used herein to refer to a structural fitting that typically turns a corner between the two spars and forms a junction of resilience to external forces. Essentially, the spar elbow connects the two spars. The angle of the spar elbow typically is any obtuse angle, though smaller angles are contemplated as well if it is desired to maintain the two objects at a closer distance from one another. Additionally, the current invention contemplates pivoting of this angle, such that as distance becomes greater between the two objects, the angle becomes larger, and vice versa. The measure of angle may be motorized as well to maintain control of the angle.

Spar: This term is used herein to refer to a thrust rod or piping leading from the saddle elbow to the spar elbow. The spar is used to maintain the relatively consistent distance between the two objects. Typically, at least two spars are needed with an elbow connection between the two in order to provide a level of flexibility to withstand external forces experienced by the spars.

Stabilize: This term is used herein to refer to maintaining the position of a component, or component thereof, of the current invention with little to no rotation.

Strap channel: This term is used herein to refer to a passageway through which and around which a strap can be directed in a conventional manner to tighten a cleat saddle to a rope cleat.

Strength enhancer: This term is used herein to refer to any supplementary structure or means of strengthening the integrity of a component. For example, the body of a cleat saddle can have a horizontal extent with vertical flanges that jut out of the body, as seen in FIG. 5A. These vertical flanges enhance the strength of the cleat saddle by not allowing the horizontal extent of the cleat saddle to bend or be manipulated across its extent in response to external forces, such as wind or waves.

Tangential relation: This term is used herein to refer to the spatial relationship of one structure merely touching or having an indirect relationship/communication with another structure.

Trail: This term is used herein to refer to a reference point as the claimed invention is described, such that the current invention is described from the "lead" object or components to the "trail" object or components. The "trail" object and components are later described and are on the right half of the system—when seen in FIG. 4C, for example—from the apical point of the spar elbow.

It will thus be seen that the objects set forth above, and those made apparent from the foregoing disclosure, are efficiently attained. Since certain changes may be made in the above construction without departing from the scope of the invention, it is intended that all matters contained in the foregoing disclosure or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A universal cleat saddle system for connecting a first object and a second object, comprising:

a cleat saddle configured to engage a rope cleat on said first object and be secured to said rope cleat, said cleat saddle including a base, a means of securing said base to said rope cleat, and an annular elbow attachment mechanism extending from said base, said annular elbow attachment mechanism having a top edge and a rotation channel disposed about the circumference of said elbow attachment mechanism in proximity to said top edge;

a saddle elbow coupled to said cleat saddle and directed away from said first object, said saddle elbow including a means of securing said saddle elbow to said cleat saddle, said rotation channel of said annular elbow attachment mechanism of said cleat saddle structured to allow rotation of said saddle elbow about said annular elbow attachment;

a first spar having a proximal end and a distal end, said proximal end of said first spar being coupled to said saddle elbow, said distal end of said first spar having a distance from said first object greater than said proximal end of said first spar;

a spar elbow having a lead portion and a trail portion, said lead portion coupled to said distal end of said first spar and directed away from said first object, said spar elbow including a means of securing said lead portion of said spar elbow to said distal end of said first spar, said trail portion of said spar elbow directed toward said second object, said lead and trail portions formed contiguously to form a juncture of resilience to external forces;

a second spar having a proximal end and a distal end, said proximal end of said second spar being coupled to said lead portion of said spar elbow, said distal end of said second spar having a distance from said first object greater than said proximal end of said second spar, said spar elbow further including a means of securing said spar elbow to said proximal end of said second spar; and an attachment apparatus for securing said distal end of said second spar to said second object.

2. A universal cleat saddle system as in claim 1, further comprising:

said attachment apparatus being:

a trail saddle elbow coupled to said distal end of said second spar and directed toward said second object, said trail saddle elbow including a means of securing said trail saddle elbow to said distal end of said second spar; and a trail cleat saddle coupled to said trail saddle elbow, said trail cleat saddle configured to engage a trail rope cleat on said second object and be secured to said trail rope cleat, said trail cleat saddle including a corresponding base and a means of securing said base to trail rope cleat.

3. A universal cleat saddle system as in claim 1, further comprising:

a second rotation channel disposed about the circumference of said first spar at an end of said first spar, said end of said first spar selected from the proximal end of said first spar and said distal end of said first spar; and a third rotation channel disposed about the circumference of said second spar at an end of said second spar, said end of said second spar selected from the proximal end of said second spar and said distal end of said second spar, whereby said second rotation channel allows rotation of said first spar and whereby said third rotation channel allows rotation of said second spar.

4. A universal cleat saddle system as in claim 3, further comprising:

a divot disposed in an opposite end of said first spar, said opposite end of said first spar being opposite from said end of said first spar where said second rotation channel is disposed, whereby said divot stabilizes said first spar.

5. A universal cleat saddle system as in claim 4, further comprising:

an additional divot disposed in an opposite end of said second spar, said opposite end of said second spar being opposite from said end of said second spar where said third rotation channel is disposed, whereby said divot stabilizes said second spar.

6. A universal cleat saddle system as in claim 1, further comprising:

a pin channel disposed in tangential relation to the exterior of said saddle elbow in alignment with said rotation channel of said saddle cleat, said pin channel structured to receive a pin that would secure a connection between said saddle cleat and said saddle elbow and allow rotation of said saddle elbow, whereby when said pin is inserted through said pin channel, said pin is disposed within said rotation channel within the interior of said saddle elbow.

7. A universal cleat saddle system as in claim 1, further comprising:

said means of securing said base to said rope cleat being a strap channel disposed vertically along said base and structured to receive a strap for tightening said saddle cleat to said rope cleat, whereby said strap can be directed around or through said strap channel.

8. A universal cleat saddle system as in claim 1, further comprising:

a strength enhancer disposed contiguously with said base of said cleat saddle to prevent bending or manipulation of said cleat saddle in response to external forces.

9. A universal cleat saddle system as in claim 1, further comprising:

a first strength enhancer disposed contiguously with said saddle elbow to prevent bending or manipulation of said saddle elbow in response to external forces; and a second strength enhancer disposed contiguously with said spar elbow to prevent bending or manipulation of said spar elbow in response to external forces.

10. A universal cleat saddle system for connecting a first object and a second object, comprising: a lead cleat saddle configured to engage a lead rope cleat on said first object and be secured to said lead rope cleat, said lead cleat saddle including a base and a means of securing said base to said lead rope cleat; a lead saddle elbow coupled to said lead cleat saddle and directed away from said first object, said lead saddle elbow including a means of securing said lead saddle elbow to said lead cleat saddle; a lead spar having a proximal end and a distal end, said proximal end of said lead spar being coupled to said lead saddle elbow, said distal end of said lead spar having a distance from said first object greater than said proximal end of said lead spar; a spar elbow having a lead portion and a trail portion, said lead portion coupled to said distal end of said lead spar and directed away from said first object, said spar elbow including a means of securing said lead portion of said spar elbow to said distal end of said lead spar, said trail portion of said spar elbow directed toward said second object, said lead and trail portions contiguously formed to form a juncture of resilience to external forces; a trail spar having a proximal end and a distal end, said proximal end of said trail spar being coupled to said trail portion said spar elbow, said distal end of said trail spar having a distance from said first object greater than said proximal end of said trail spar, said spar elbow further including a means of securing said spar elbow to said proximal end of said trail spar; a trail saddle elbow coupled to said distal end of said trail spar and directed toward said second object, said trail saddle elbow including a means of securing said trail saddle elbow to said distal end of said trail spar; and a trail cleat saddle coupled to said trail saddle elbow, said trail cleat saddle configured to engage a trail rope cleat on said second object and be secured to said trail rope cleat, said trail cleat saddle including a corresponding base and a means of securing said base to trail rope cleat;

the lead cleat saddle having a lead annular elbow attachment mechanism with a top edge and a first rotation channel disposed about the circumference of said lead elbow attachment mechanism in proximity to said top edge of said lead elbow attachment mechanism, said first rotation channel of said lead cleat saddle structured to allow rotation of said lead saddle elbow about said lead cleat saddle; and said trail cleat saddle having a trail annular elbow attachment mechanism with a top edge and a second rotation channel disposed about the circumference of said trail elbow attachment mechanism in proximity to said top edge of said trail elbow attachment mechanism, said second rotation channel of said trail cleat saddle structured to allow rotation of said trail saddle elbow about said trail cleat saddle.

11. A universal cleat saddle system as in claim 10, further comprising:

a first strength enhancer disposed contiguously with said base of said lead cleat saddle to prevent bending or manipulation of said lead cleat saddle in response to external forces; and a second strength enhancer disposed contiguously with said base of said trail cleat saddle to prevent bending or manipulation of said trail cleat saddle in response to external forces.

12. A universal cleat saddle system as in claim 10, further comprising:

a first strength enhancer disposed contiguously with said lead saddle elbow to prevent bending or manipulation of said lead saddle elbow in response to external forces;

a second strength enhancer disposed contiguously with said spar elbow to prevent bending or manipulation of said spar elbow in response to external forces; and a third strength enhancer disposed contiguously with said trail saddle elbow to prevent bending or manipulation of said trail saddle elbow in response to external forces.

13. A universal cleat saddle system as in claim 10, further comprising:

a first rotation channel disposed about the circumference of said lead spar at an end of said lead spar, said end of said lead spar selected from the proximal end of said lead spar and said distal end of said lead spar; and a second rotation channel disposed about the circumference of said trail spar at an end of said trail spar, said end of said trail spar selected from the proximal end of said trail spar and said distal end of said trail spar, whereby said first rotation channel allows rotation of said lead spar and whereby said second rotation channel allows rotation of said trail spar.

14. A universal cleat saddle system as in claim 13, further comprising:

a divot disposed in an opposite end of said lead spar, said opposite end of said lead spar being opposite from said end of said lead spar where said first rotation channel is disposed, whereby said divot stabilizes said lead spar.

15. A universal cleat saddle system as in claim 14, further comprising:

an additional divot disposed in an opposite end of said trail spar, said opposite end of said trail spar being opposite from said end of said trail spar where said second rotation channel is disposed, whereby said divot stabilizes said trail spar.

16. A universal cleat saddle system as in claim 10, further comprising: a pin channel disposed in tangential relation to the exterior of said lead saddle elbow in alignment with said rotation channel of said lead saddle cleat, said pin channel structured to receive a pin that would secure a connection between said lead saddle cleat and said lead saddle elbow and allow rotation of said lead saddle elbow, whereby when said pin is inserted through said pin channel, said pin is disposed within said rotation channel within the interior of said lead saddle elbow.

17. A universal cleat saddle system as in claim 10, further comprising:

said means of securing said base of said lead cleat saddle to said lead rope cleat being a first strap channel disposed vertically along said base of said lead cleat saddle and structured to receive a first strap for tightening said lead saddle cleat to said lead rope cleat, whereby said first strap can be directed around or through said first strap channel; and said means of securing said base of said trail cleat saddle to said trail rope cleat being a second strap channel disposed vertically along said base of said trail cleat saddle and structured to receive a second strap for tightening said trail saddle cleat to said trail rope cleat, whereby said second strap can be directed around or through said second strap channel.

18. A cleat saddle that engages a rope cleat having opposing cleat horns, comprising:

a base having a horizontal extent and a vertical extent;

a set of cleat teeth extending from the bottom of said vertical extent of said base and structured to conform to a shape of said opposing cleat horns of said rope cleat;

a means of securing said cleat saddle to said rope cleat; and an annular attachment mechanism extending vertically from said vertical extent of said base, said annular attachment mechanism having a top edge and a rotation channel disposed about the circumference of said attachment mechanism in proximity to said top edge, said annular attachment mechanism structured to engage an extension apparatus in overlying relation to said top edge of said attachment mechanism, said rotation channel permitting said extension apparatus to rotate about said annular attachment mechanism.

19. A universal cleat saddle system as in claim 18, further comprising:

said means of securing said cleat saddle to said rope cleat being a strap channel disposed along said vertical extent of said base and structured to receive a strap for tightening said saddle cleat to said rope cleat, whereby said strap can be directed around or through said strap channel.

20. A universal cleat saddle system as in claim 18, further comprising:

a strength enhancer disposed contiguously with said base of said cleat saddle to prevent bending or manipulation of said cleat saddle in response to external forces.

* * * * *